US007892048B2

(12) United States Patent
Shi et al.

(10) Patent No.: US 7,892,048 B2
(45) Date of Patent: Feb. 22, 2011

(54) CABLE END CONNECTOR AND METHOD OF ASSEMBLING THE SAME

(75) Inventors: Xiankui Shi, Kunsan (CN); Jerry Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 2264 days.

(21) Appl. No.: 10/604,816

(22) Filed: Aug. 19, 2003

(65) Prior Publication Data

US 2004/0110427 A1 Jun. 10, 2004

(30) Foreign Application Priority Data

Aug. 23, 2002 (TW) ..... 91119073

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 4,583,805 A 4/1986 Mantlik
4,752,251 A 6/1988 Kato et al.
4,787,864 A * 11/1988 Hunt et al. ..... 439/595
4,944,688 A * 7/1990 Lundergan ..... 439/275
5,059,142 A * 10/1991 Ohta et al. ..... 439/752
5,061,210 A 10/1991 Jinno
5,071,373 A 12/1991 Nagasaka et al.
5,183,418 A * 2/1993 Yamanashi et al. ..... 439/752
RE34,539 E 2/1994 Aoyama
5,299,958 A * 4/1994 Ohsumi ..... 439/752
5,358,431 A * 10/1994 Yamamoto et al. ..... 439/752
5,411,421 A * 5/1995 McCardell, Jr. ..... 439/879
5,470,258 A * 11/1995 Suzuki et al. ..... 439/595
5,489,223 A 2/1996 Faje et al.
5,595,509 A * 1/1997 Fry et al. ..... 439/752
5,643,009 A * 7/1997 Dinkel et al. ..... 439/595
5,980,331 A * 11/1999 Matsushita et al. ..... 439/752
6,149,462 A * 11/2000 Sugie ..... 439/595
6,183,314 B1 * 2/2001 Wada et al. ..... 439/752

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector (1), connected with a cable (5), comprises an insulative housing (2) having a plurality of cavities, a plurality of terminals (3) received in the cavities, and a latching member (4) attached to the housing. The latching member has a base plate (40) and a plurality of silos (44) extending from the base plate. A diameter of a channel (48) in each of the silos is slightly larger than a diameter of a corresponding wire (50) of the cable. During assembly of the connector and the cable, the wires of the cable extend through the channels of the latching member prior to connection of the terminals and the wires.

8 Claims, 7 Drawing Sheets

CABLE END CONNECTOR AND METHOD OF ASSEMBLING THE SAME

BACKGROUND OF INVENTION

1. Field of the Invention

The present invention relates to a cable end connector and method of assembling a cable into the connector, and more particularly, to a cable end connector having a latching member and a method of assembling the cable into the connector which comprises a step of extending wires of the cable through the latching member prior to terminals of the connector being attached to the wires.

2. Description of Related Art

A cable end connector commonly comprises an insulative housing having a plurality of cavities defined therein, and a plurality of electrical terminals received in the cavities. Each terminal is electrically connected with a corresponding wire of a cable by a particular interconnecting means; for example, by crimping the wire within a pair of arms formed on the terminal. However, in use, the terminal may occasionally sustain an unexpected pulling force acting on the wire in a direction opposite to the direction of original insertion of the terminal into the corresponding cavity. This can lead to displacement of the terminal or even disengagement of the terminal from within the cavity. Therefore, it is desirable to develop locking systems which can stably secure the terminal in the cavity.

Recently, several different terminal locking systems directed to the above-described problems have been developed. For instance, U.S. Pat. No. 5,489,223 issued to Richard et al. discloses one kind of electrical connector with terminal locking means. The terminal locking means includes a pair of cantilever arms extending from the main body of the terminal in a slantwise manner. When the terminal is inserted into the cavity of the housing, the arm abuts a shoulder formed in the cavity. Thus, the terminal is retained in the cavity by a resisting force generated from the shoulder. However, electrical terminals most commonly used in the electrical connector are made of some kind of relatively soft metallic material, such as copper or copper alloy. A terminal made of such material is often not hard enough to provide a sufficient resisting force for retaining the terminal in the cavity.

U.S. Pat. No. 5,004,436 and Re. 34,539 both disclose another conventional electrical connector having a different locking structure. The connector includes an insulative housing defining cavities each adapted to accommodate a terminal therein, and a latching member adapted to be attached to the housing for securing the terminals in the cavities. The latching member comprises first latching means which can position the latching member at a first position relative to the housing, and second means and third latching means which can position the latching member at a second position relative to the housing. When the latching member is at the second position, a locating portion thereof extends into the cavities thereby locating the terminals in the cavities. In the process of assembling the cable with the connector, the latching member is firstly attached to the housing and located at the first position by the first latching means. Then the terminals with the wires of the cable already connected thereto are extended through openings of the latching member and received in the cavities of the housing. Finally, the latching member is pushed to the second position, and is secured to the housing by the second and third latching means.

The above-described locking structure can ensure stable retention of the terminals in the cavities, but it still have some disadvantages. The latching member is located at the first position prior to the terminals being inserted into the cavities of the housing. The configuration of each terminal is rather irregular, which makes it difficult to insert the terminal through the corresponding opening of the latching member. That is, when the terminal having the wire of the cable already connected thereto is inserted into the opening of the latching member, the terminal inevitably interferes with inner walls of the latching member surrounding the opening because of the relatively small dimension of the opening. As a result, the latching member is prone to be prematurely pushed to its second position by the terminal. When this happens, the latching member prevents the terminal from entering the corresponding cavity of the housing, since the cavity has been blocked by the locating portion of the latching member. Therefore, assembly of the connector and the cable cannot be readily achieved.

SUMMARY OF INVENTION

Accordingly, an object of the present invention is to provide a method for readily assembling a cable into a connector and stably securing terminals in the connector.

Another object of the present invention is to provide a cable end connector having an improved latching member which facilities assembly of a cable in the cable end connector.

In order to fulfill the above objects, an electrical connector in accordance with the present invention comprises an insulative housing having a plurality of cavities, a plurality of electrical terminals adapted to be received in corresponding cavities of the housing, and a latching member having a plurality of channels adapted to accommodate wires of a cable to extend therethrough. A cable comprises a plurality of wires, each wires is electrically connected with a corresponding terminal. A diameter of each channel of the latching member is slightly larger than a diameter of the wire. The latching member has a plurality of latches formed thereon for engaging corresponding blocks formed on the housing, thereby securing the latching member to the housing.

The assembly of the connector and the cable comprises five main steps. Firstly, the cable end connector and the cable are provided. Secondly, each of the wires of the cable extends throughout a corresponding channel of the latching member, and a predetermined length of each wire protrudes out from the channel. Thirdly, each of the terminals is attached to one end of a corresponding wire of the cable, and a predetermined distance is remained between the terminals and the latching member. Then, in the fourth step, the terminals are inserted into corresponding cavities of the housing and extend reach their correct positions in the cavities, and the distance between the terminal and the latching member is big enough so that the latching member does not contact the housing in this step. Finally, the latching member is pushed toward the housing with the channels of the latching member being inserted into the cavities of the housing. Simultaneously the latches of the latching member engage with the blocks of the housing. Therefore, the terminals are positioned in the cavities.

Other objects, advantages and novel features of the present invention will become more apparent from the following detailed description when taken in conjunction with the accompanying drawings, in which:

DETAILED DESCRIPTION

Figure 1:
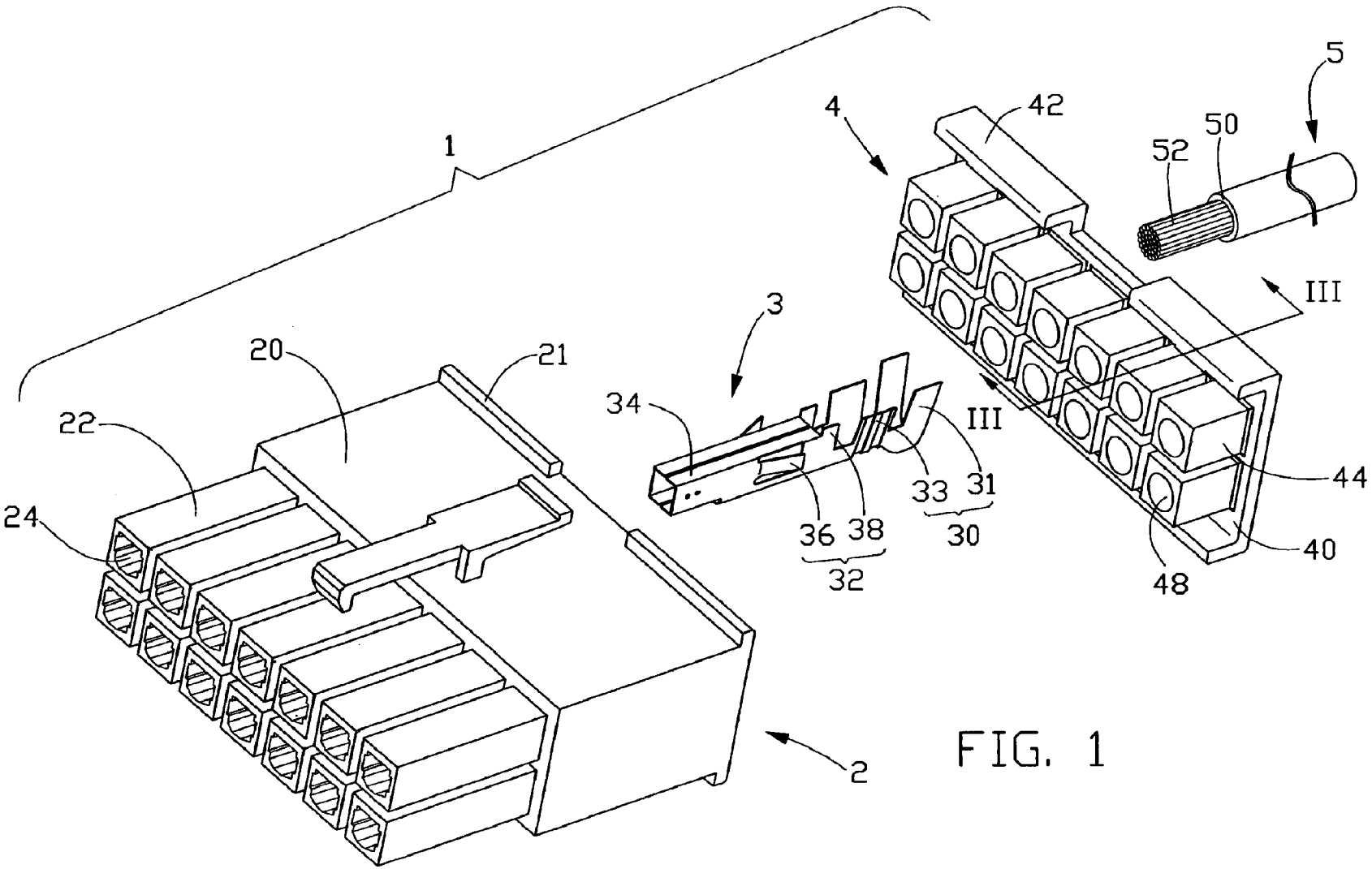
FIG. 1 is an exploded view of an electrical connector in accordance with a preferred embodiment of the present invention, but showing only one terminal and one wire of a cable thereof.

Referring to FIG. 1, a cable end connector 1 in accordance with the preferred embodiment of the present invention comprises an insulative housing 2, a plurality of electrical terminals 3 adapted to be received in the housing 2, and a latching member 4 adapted to be attached to the housing 2. In FIG. 1, for the purposes of simplifying the drawing, only one terminal 3 is illustrated. A multi-wire cable 5 is adapted to be connected with the terminals 3. The cable 5 comprises a plurality of wires 50. In FIG. 1, for the purposes of simplifying the drawing, only one wire 50 is illustrated. Each wire 50 comprises a core conductor 52.

Figure 6:
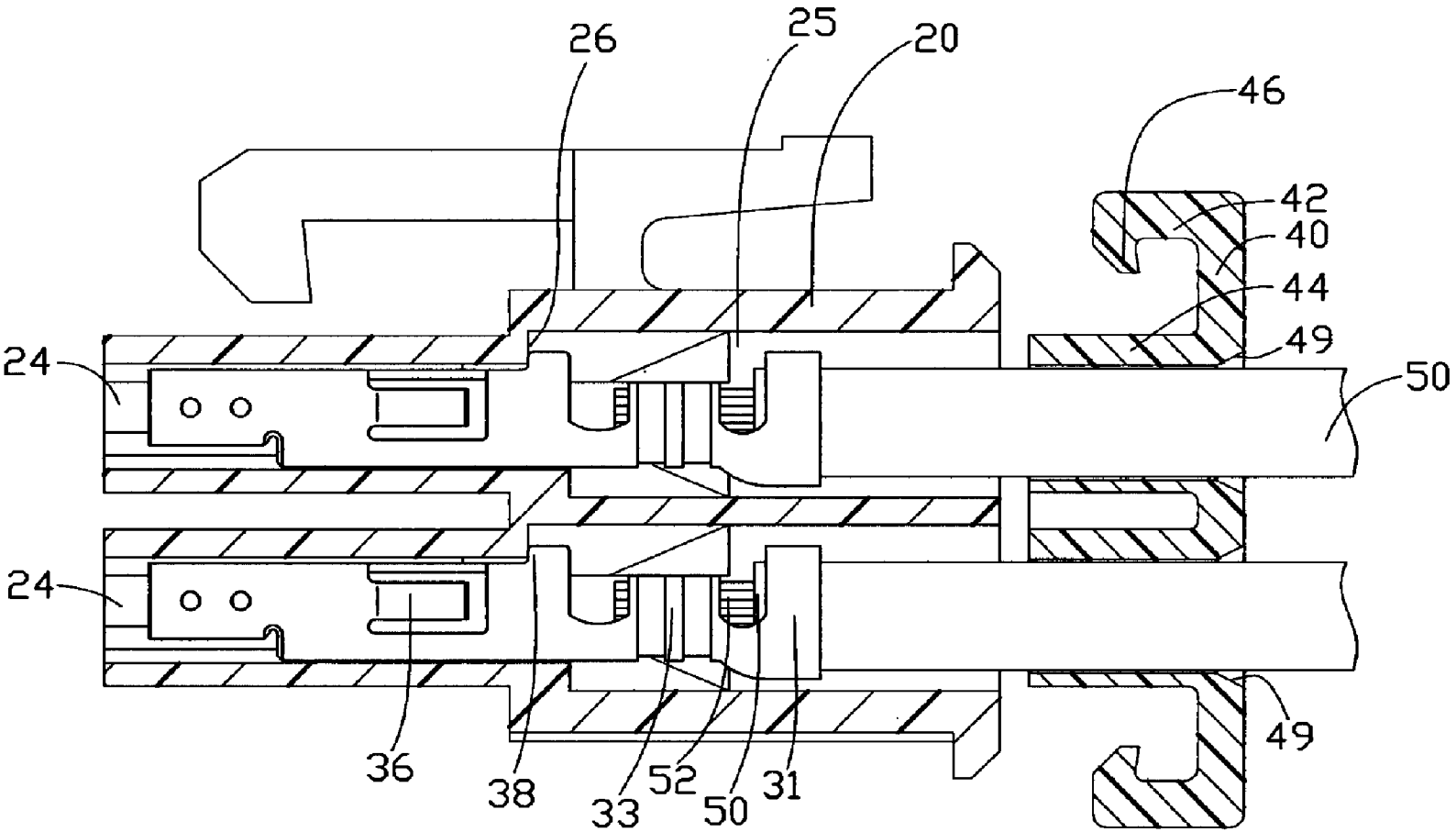
FIG. 6 is similar to FIG. 5, but showing the terminals inserted into corresponding cavities of a housing of the electrical connector of FIG. 1, with part of the housing being shown in cross-section.

Referring to FIGS. 1 and 6, the housing 2 comprises a base portion 20, and a plurality of silos 22 extending from the base portion 20 and arranged in two rows. A plurality of cavities is defined in the housing. Each cavity comprises a broader portion 25 in the base portion 20, and a narrower portion 24 in a corresponding silo 22. A shoulder 26 is thereby formed in the housing 2 where each narrower portion 24 adjoins its corresponding broader portion 25. A pair of aligned blocks 21 is formed on each of opposite main faces of the base portion 20, at an end of the base portion 20 distal from the silos 22. The terminal 3 includes a connecting portion 30, a securing portion 32, and a mating portion 34. The connecting portion 30 comprises a pair of first clasps 31 and a pair of second clasps 33. The first and second clasps 31, 33 are adapted to crimp the wire 50 when the cable 5 is connected with the terminal 3. The securing portion 32 comprises a pair of opposite first spring arms 36 extending therefrom in a slantwise manner for pressing inner side walls that bound the narrower portion 24 in the corresponding silo 22, and a pair of second spring arms 38 extending upwardly therefrom for abutting the shoulder 26 at the silo 22. The mating portion 34 extends through the narrower portion 24 of the silo 22, for mating with a mating terminal (not shown) inserted therein.

Figure 3:
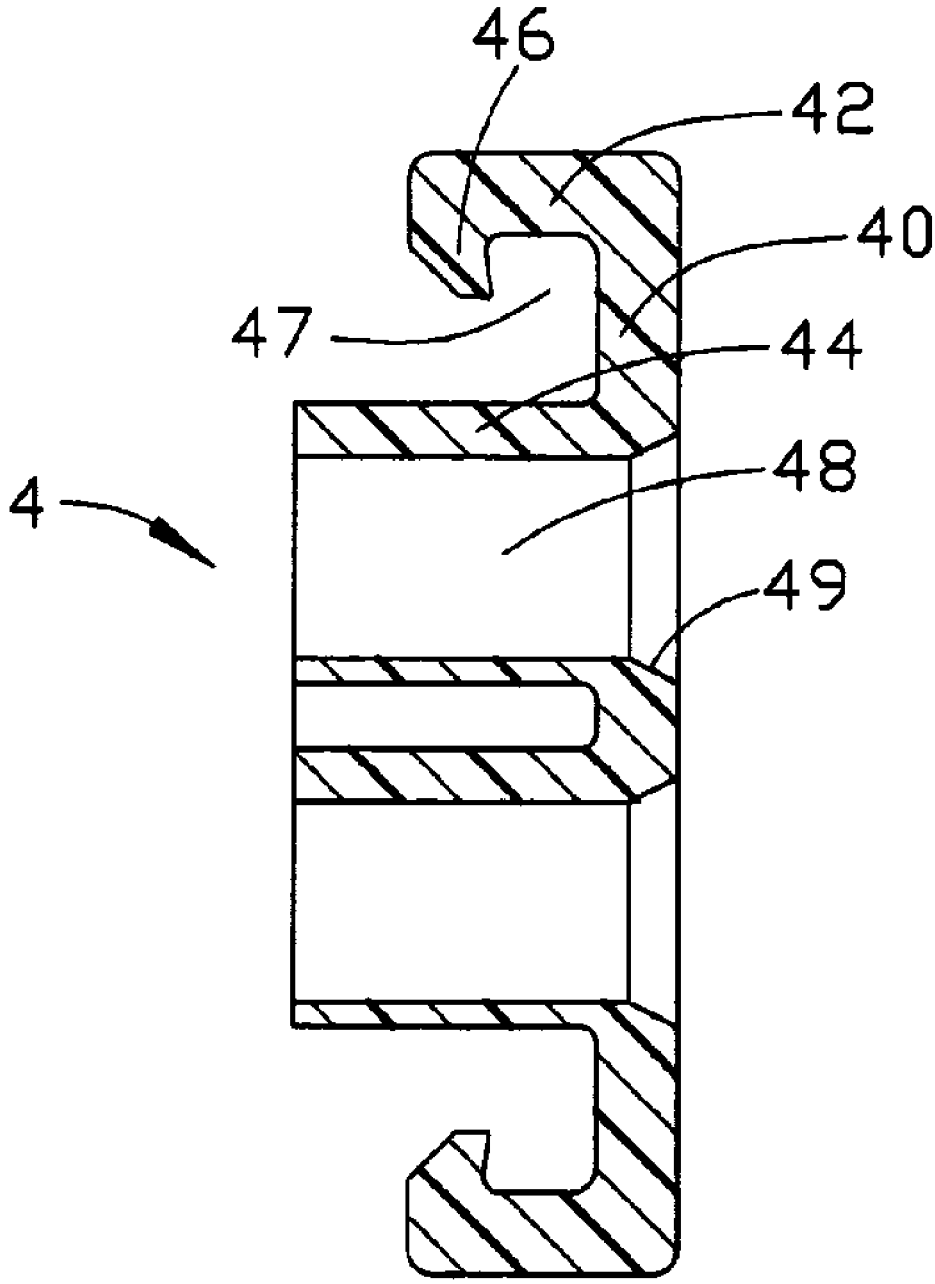
FIG. 3 is a cross-sectional view of a latching member of the electrical connector of FIG. 1, taken along line III-III thereof.

Referring to FIGS. 1 and 3, the latching member 4 comprises a base plate 40 and two rows of silos 44 extending from the base plate 40. Each silo 44 defines a central channel 48 therethrough. A diameter of each channel 48 is slightly larger than a diameter of each wire 50. A beveled, annular leading portion 49 is formed in the base plate 40 at one end of the channel 48, for facilitating insertion of the wire 50. The latching member 4 further comprises a pair of latches 42 extending from the base plate 40 at each of opposite sides of the rows of silos 44. The latches 42 are substantially parallel to the silos 44. Each latch 42 has a hook 46 formed at a free end thereof for latching with a corresponding block 21 of the base portion 20 of the housing 2. The hook 46 extends inwardly toward the silos 42 in a direction substantially perpendicular to the silos 44, thereby defining a receiving space 47 for accommodating the block 21.

Figure 2:
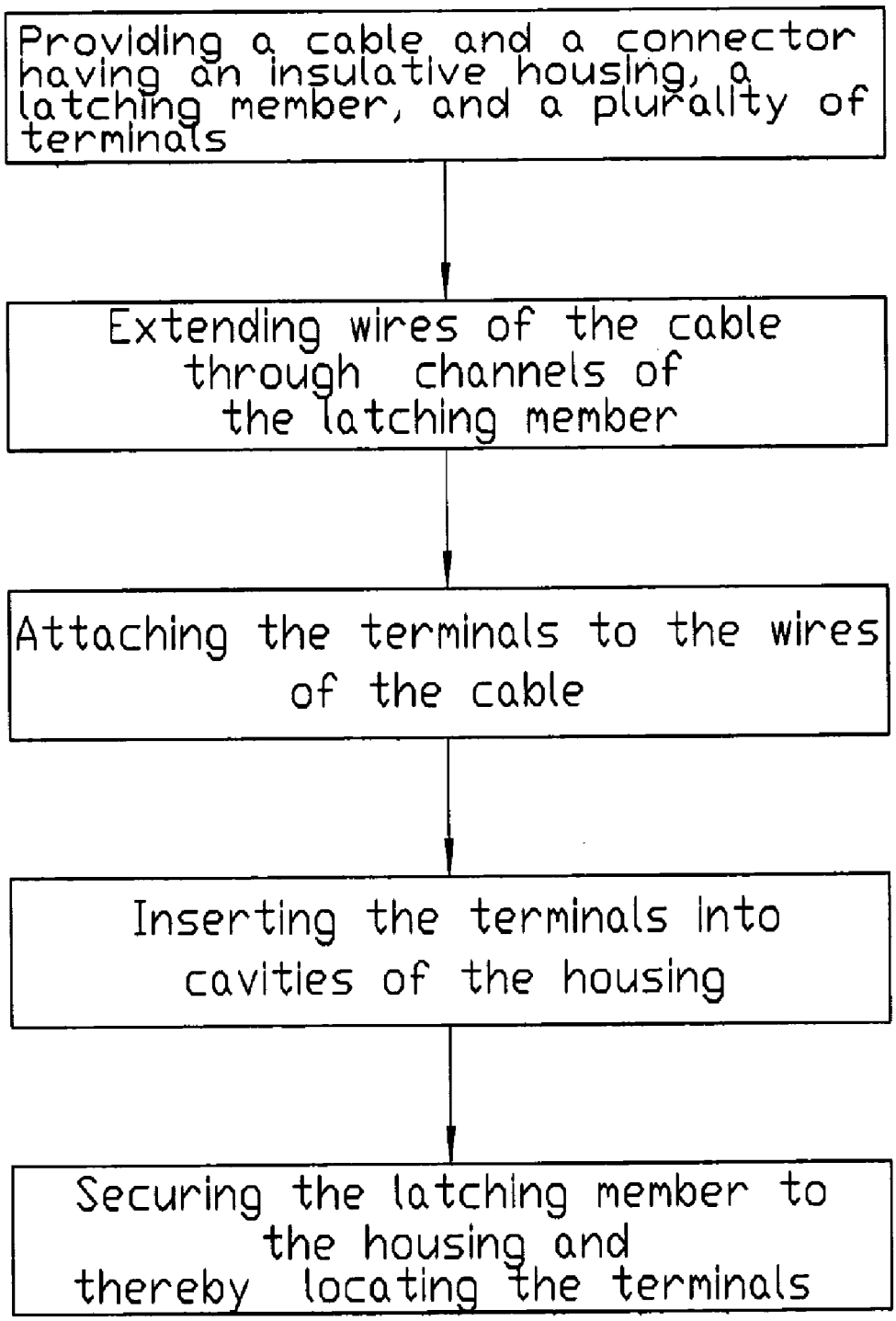
FIG. 2 is a flow chart of a preferred method of assembling the electrical connector of FIG. 1.
Figure 4:
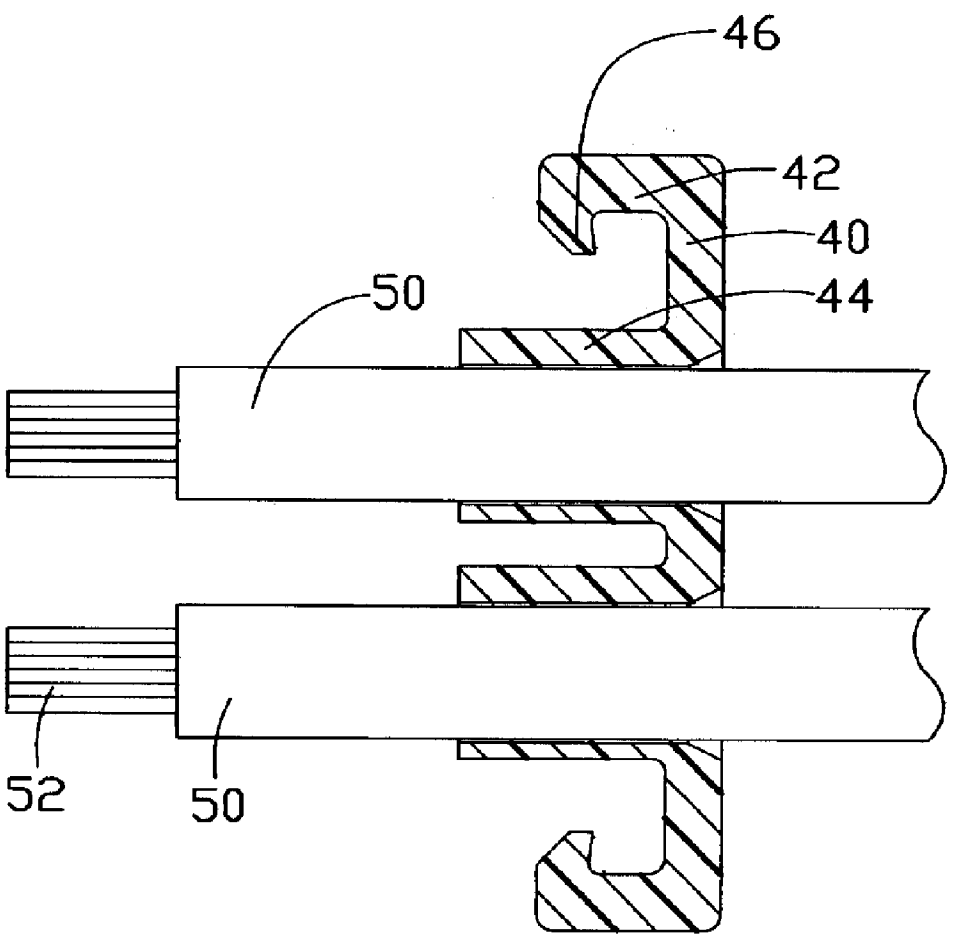
FIG. 4 is similar to FIG. 3, but showing two wires of the cable of the electrical connector of FIG. 1 extended through channels of the latching member.
Figure 5:
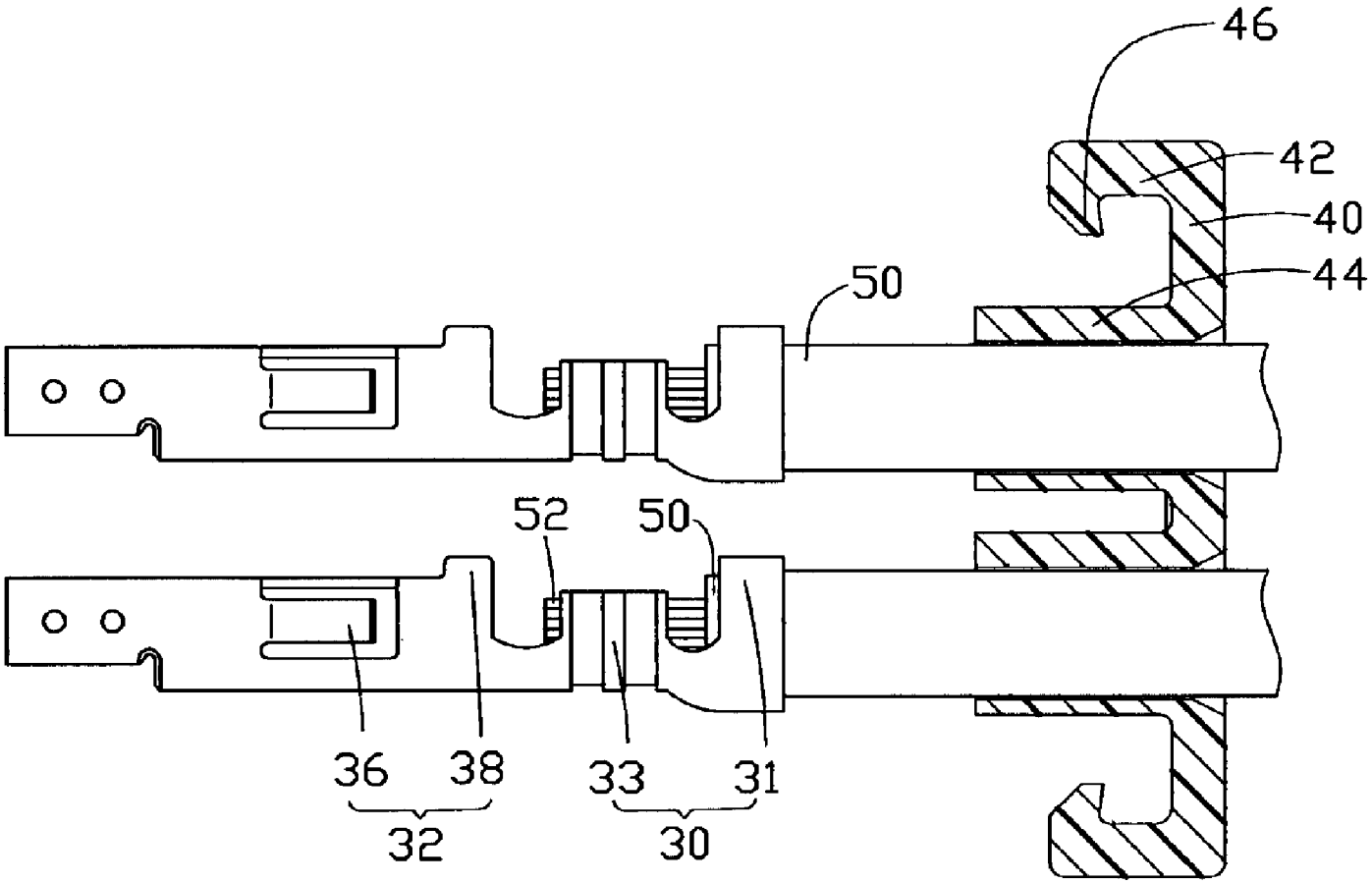
FIG. 5 is similar to FIG. 4, but showing two terminals of the electrical connector of FIG. 1 attached to the wires of the cable.
Figure 7:
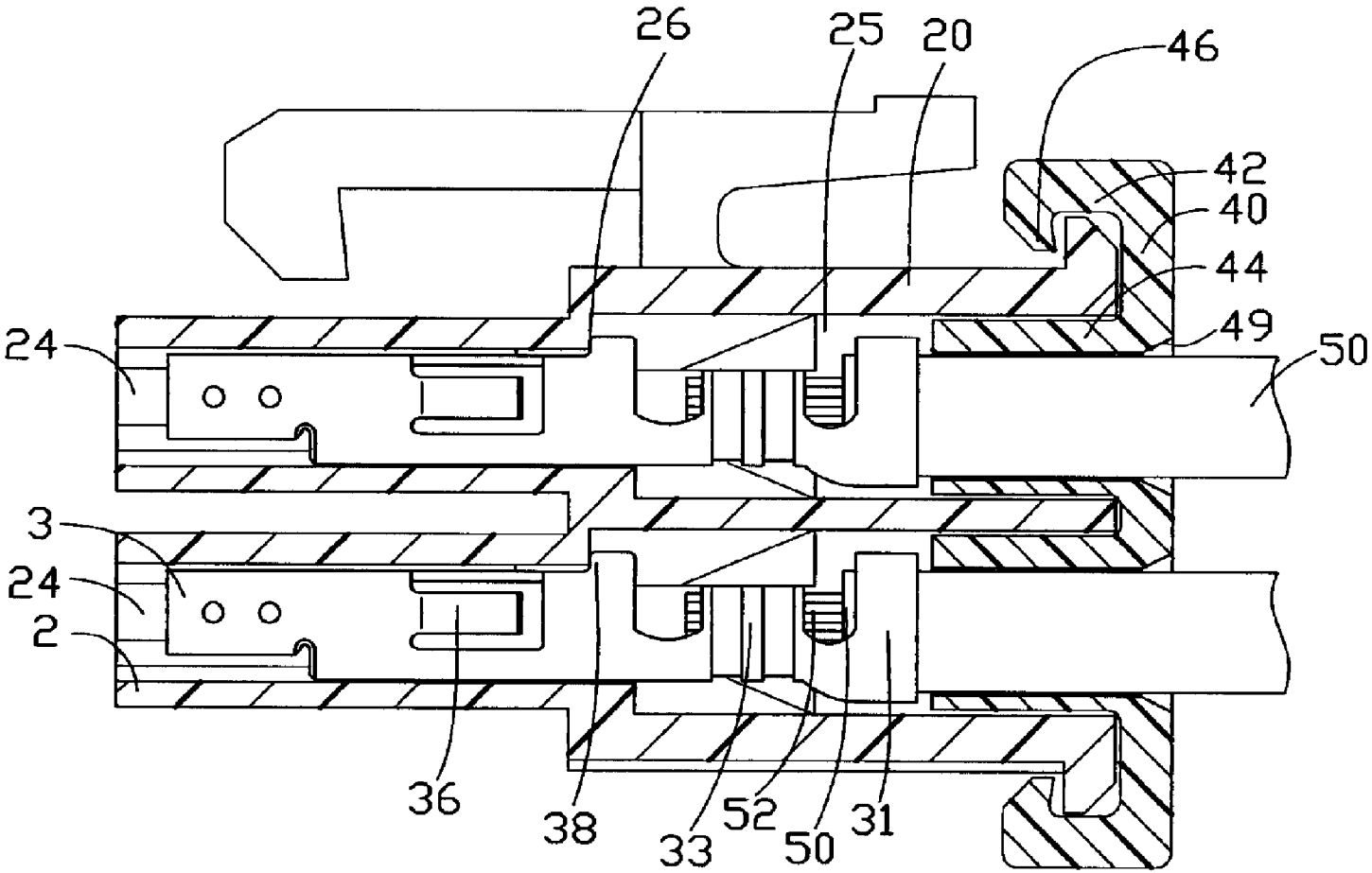
FIG. 7 is similar to FIG. 6, but showing the latching member secured to the housing and locating the terminals in the cavities of the housing.

Referring to FIG. 2, the assembly of the cable end connector 1 and the cable 5 comprises five main steps. Referring also to FIG. 1, in the first step, the connector 1 and the cable 5 are provided. The connector 1 comprises the housing 2, the terminals 3 adapted to be received in the housing 2, and the latching member 4 adapted to be attached to the housing 2. The cable 5 comprises the plurality of wires 50. Referring also to FIG. 4, in the second step, the wires 50 are extended into the channels 48 of the latching member 4 via the leading portions 49. A predetermined length of each wire 50 protrudes out from an opposite end of its silo 44, with the conductor 52 being exposed at a free end of the wire 50. Referring also to FIG. 5, in the third step, the terminals 3 are attached to the corresponding wires 50. The first clasps 31 of the connecting portion 30 of each terminal 3 are fastened to an outer insulative jacket of a corresponding wire 50, and the second claps 33 of the connecting portion 30 are fastened to the conductor 52 of the wire 50. Referring also to FIG. 6, in the fourth step, the terminals 3 are inserted into cavities of the housing 2. The mating portion 34 and part of the securing portion 32 of each terminal 3 are located in the narrower portion 24 of a corresponding cavity. The first spring arms 36 press against opposite inner side walls of the housing 2 that bound the narrower portion 24, thereby locating the mating portion 34 in the narrower portion 24. The connecting portion 30 and a remaining part of the securing portion 32 are located in the broader portion 25 of the cavity. The second spring arms 38 abut the shoulder 26, thereby preventing the mating portion 34 from being over-extended out of the silo 22. In this step, the latching member 4 does not contact the housing 2, and the corresponding silo 44 remains a distance from the broader portion 25 of the cavity. This enables the terminal 3 to easily reach its correct position in the cavity. Referring also to FIG. 7, in the fifth step, the latching member 4 is attached to the housing 2. The silos 44 are inserted into the broader portions 25 of the cavities, and the latches 42 snappingly engage with the blocks 21 of the housing 2. Any displacement of each terminal 3 along the direction of insertion of the corresponding silo 44 is prevented by the second spring arms 38 abutting the shoulder 26. In addition, any displacement of the terminal 3 in a direction opposite to said direction of insertion is prevented by the engagement of the latches 42 with the blocks 21. Thus, the terminals 3 are stably located in the cavities of the housing 2.

Unlike in conventional art, the wires 50 of the cable 5 are positioned in the latching member 4 prior to connection of the terminals 3 to the wires 50. This obviates the above-described related art difficulty of inserting wires with terminals already attached through channels of a latching member. That is, the assembly process of the present invention removes the related art step of inserting wires with terminals already attached through channels of a latching member. Therefore, the cable 5 can be easily assembled to the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. A method of assembling an electrical connector and a cable, the connector including an insulative housing defining a plurality of cavities each adapted to receive a corresponding electrical terminal having clasps and a latching member defining channels, the cable including a plurality of wires, the method comprising the steps of:

extending each of the wires of the cable through a corresponding channel of the latching member;

attaching said each of the wires to a corresponding terminal with the clasps of the terminal being curved to engagingly wrap a part of said each of the wires, the post-curved clasps having a portion to interferingly engage the latching member at said channel thereby preventing the terminal from moving rearwardly;

inserting the terminal into a corresponding cavity of the housing; and securing the latching member to the housing thereby the post-curved clasps abut against the latch at said channel so as to locate the terminal in the cavity, wherein the latching member comprises a base plate, and a plurality of silos extending from the base plate, wherein the base plate comprises a plurality of latches provided thereon, wherein the housing comprises a plurality of blocks provided thereon, the blocks engaging with the latches of the latching member, wherein each of the silos of the latching member is in alignment with a corresponding cavity of the housing and can be inserted into the cavity when the latching member is secured to the housing.

2. The method as claimed in claim 1, wherein the post-curved clasps cooperatively have a section periphery larger than said opposite end of the channel.

3. The method as claimed in claim 2, wherein the clasps comprise a pair of clasps clamped an out jacket of said each of the wires.

4. The method as claimed in claim 3, wherein the terminal further comprises a pair of clips engagingly wrapped a conductor of said each of the wires.

5. An electrical connector adapted to be connected with a cable, the electrical connector comprising:

an insulative housing defining a plurality of cavities;

a plurality of electrical terminals received in corresponding cavities of the housing, each of the terminals having a connecting portion with at least one clasp adapted to connect to a corresponding wire of the cable before the wire is inserted into a corresponding cavity of the housing;

a latching member attached to the housing, the latching member including a base portion, and a plurality of silos extending from the base portion and inserted into corresponding cavities of the housing; and wherein each of the silos defines a channel therethrough, the channel having a diameter slightly greater than a diameter of a corresponding wire to facilitate insertion of the wire therethrough, when the latching member is secured to the housing, said at least one clasp is situated outside a corresponding channel and adjacent the housing and prone to abut against the latching member at one end of the channel to prevent the terminal from escaping from a corresponding cavity of the housing when the terminal is urged rearwardly, wherein the housing comprises a base and a plurality of silos extending from the base, and each of the cavities comprises a narrower portion in a corresponding silo and a broader portion in the base, whereby a shoulder is defined where the narrower portion adjoins the broader portion, wherein each of the terminals comprises a securing portion having a pair of first spring arms pressing inner walls of a corresponding silo in the narrower portion thereof, and a pair of second spring arms abutting a corresponding shoulder, wherein the base portion of the latching member comprises a plurality of latches, and each of the latches engages with a corresponding block provided on the housing.

6. The electrical connector as claimed in claim 5, wherein said at least one clasp has a section periphery larger than said channel of the latching member.

7. The electrical connector as claimed in claim 6, wherein said at least one clasp is adapted to clamp an out jacket of the wire.

8. An electrical connector comprising:

an insulative housing;

a plurality of cavities extending through the housing along a front-to-back direction;

a plurality of terminals received in the corresponding cavities, respectively;

a latching member attached to a rear portion of the housing and including a base with a plurality of silos extending forwardly therefrom into the corresponding cavities, respectively, each of said silos defining an inner channel axially; and a plurality of wires forwardly extending through the corresponding channels, respectively, each of said wires including an outer jacket and an inner conductor commonly secured to the corresponding one of said terminals; wherein the housing includes in each of the cavities a portion preventing forward movement of the corresponding terminal, and each of the silos includes another portion to engagingly restrict the corresponding terminal outside a corresponding channel thereby preventing rearward movement of the corresponding terminal, wherein each of said terminal includes a connection portion on a rear end section to secure to the inner conductor and the outer jacket of the corresponding terminal, and said connection portion is dimensioned larger than the corresponding channel so that the corresponding terminal can not rearwardly move through said channel, wherein each of said terminals are connected to the corresponding wires, respectively, only after the corresponding wires forwardly extend through the corresponding channels, respectively, from a rear face of the latching member, wherein prevention of the rearward movement of each of the terminals results from engagement between the connection portion and the corresponding silo.

* * * * *